US005501339A

United States Patent [19]

Suzuki et al.

[11] Patent Number: 5,501,339

[45] Date of Patent: Mar. 26, 1996

[54] PACKING BOX WITH CRADLE SHAPED PORTION

[75] Inventors: Shintaro Suzuki; Toru Matsushita, both of Hamamatsu, Japan

[73] Assignee: Sanshin Kogyo Kabushuki Kaisha, Hamamatsu, Japan

[21] Appl. No.: 283,605

[22] Filed: Aug. 1, 1994

Related U.S. Application Data

[62] Division of Ser. No. 69,986, May 28, 1993, Pat. No. 5,372, 259.

[30] Foreign Application Priority Data

Jun. 9, 1992 [JP] Japan ..... 4-174894
Jun. 9, 1992 [JP] Japan ..... 4-174895

[51] Int. Cl.[6] ..... B65D 81/10

[52] U.S. Cl. ..... 206/586; 206/588; 206/583

[58] Field of Search ..... 206/586, 587, 206/588, 590, 591, 592, 521, 320, 583

[56] References Cited

U.S. PATENT DOCUMENTS

| | | | |
|---|---|---|---|
| 1,370,525 | 3/1921 | Eisenkraft | 206/587 X |
| 1,456,098 | 5/1922 | Doane | 206/592 X |
| 1,677,565 | 7/1928 | Oppenheim . | |
| 1,713,548 | 5/1929 | Oppenheim . | |
| 2,000,158 | 5/1935 | Black et al. . | |
| 2,314,491 | 3/1943 | Greenberg | 206/587 |
| 2,507,929 | 5/1950 | Pennebaker . | |
| 2,646,165 | 7/1953 | Whitehead | 206/592 |
| 2,733,851 | 2/1956 | Van Ness . | |
| 2,753,101 | 7/1956 | Zimmerman . | |
| 2,868,428 | 1/1959 | Bergstrom | 206/592 X |
| 2,914,232 | 11/1959 | Budd . | |
| 3,015,428 | 1/1962 | Magazzu | 206/592 |
| 3,211,282 | 10/1965 | Hennessey . | |
| 4,211,356 | 6/1980 | Tsuchiya et al. . | |
| 4,438,848 | 3/1984 | Montealegre et al. . | |

FOREIGN PATENT DOCUMENTS

| | | |
|---|---|---|
| 61-152586 | 7/1986 | Japan . |
| 63-307074 | 12/1988 | Japan . |

*Primary Examiner*—Bryon P. Gehman
*Attorney, Agent, or Firm*—Knobbe, Martens, Olson & Bear

[57] ABSTRACT

Two embodiments of corrugated paper shipping boxes that can be knocked down into a flat form and in which a cradle support is also formed by corrugated paper for holding the shipped article away from the sides of the box. In one embodiment, the cradle is formed by extensions of the end flaps of the end walls of the box and in another embodiment, the cradle is formed as a separate assemblage also from corrugated paper and adapted to be folded into a flat configuration. This facilitates storage and disposal and eliminates the use of foamed plastic insert pieces.

7 Claims, 6 Drawing Sheets

PACKING BOX WITH CRADLE SHAPED PORTION

This application is a division of application Ser. No. 08/069,986, filed May 28, 1993, now U.S. Pat. No. 5,372, 259.

BACKGROUND OF THE INVENTION

This invention relates to a packing box and more particularly to an improved shipping container that can be formed substantially entirely from corrugated material.

It is well known that a variety of articles are packed for shipment. Conventionally, it has been the practice to place these articles in a box formed from corrugated paper. The corrugated paper boxes have a number of advantages in that they can be formed from folded material in a flatten shape which can be easily stored. When required for packing purposes, the box can be folded into its box-like configuration. In the same nature, once the box has served its purpose, it can be refolded into a flat configuration for either disposal or for reuse.

However, in the shipment of many types of articles it is the practice to insure that the article being shipped does not contact the inner surfaces of the packing box. That is, it is desirable to hold the shipped article inwardly from the sides of the box so that if the box becomes crushed or damaged in shipment, the contained article will not become damaged.

A variety of devices have been proposed for holding the article in spaced relationship to the interior of the box. For example, foamed plastics are frequently used for this purpose. Although the foamed plastics are effective, they themselves present a problem both in storage before use and in disposal after use. There have, therefore, been proposed corrugated types of spacing devices which may be stored in a flat configuration but which must be folded into their supporting configuration. The types of devices previously proposed for this purpose have been quite cumbersome or, alternatively, it has been required to provide a number of individual inserts which must be folded into their configuration and then inserted into the box.

It is, therefore, a principal object to this invention to provide an improved and simplified packing box which can be formed entirely from a corrugated material.

It is a further object to this invention to provide an improved corrugated packing box that incorporates a simple and yet effective corrugated spacer for holding the contained article away from contact with the sides of the box.

It is a still further object to this invention to provide an improved and simplified corrugated box and spacer arrangement which is also formed from corrugated material, either as a separate piece or integrally with the box and which has a simple folding arrangement.

SUMMARY OF THE INVENTION

This invention is adapted to be embodied in a packing box for shipping articles and which packing box is formed primarily substantially from corrugated paper. The box has a substantially flat configuration prior to its formation into a substantially cubicle box configuration for receiving and containing the shipped articles. The interior of the box when in its box configuration defines at least a lower cradle shape portion that defines a recess to receive and nest the article within the box and to space the article inwardly from the inner surface of the box for shipping protection. The cradle shape portion is formed solely from corrugated paper and is foldable from a flat section when the box is formed to form the cradle.

DETAILED DESCRIPTION OF THE PREFERRED EMBODIMENTS OF THE INVENTION

Figure 1:
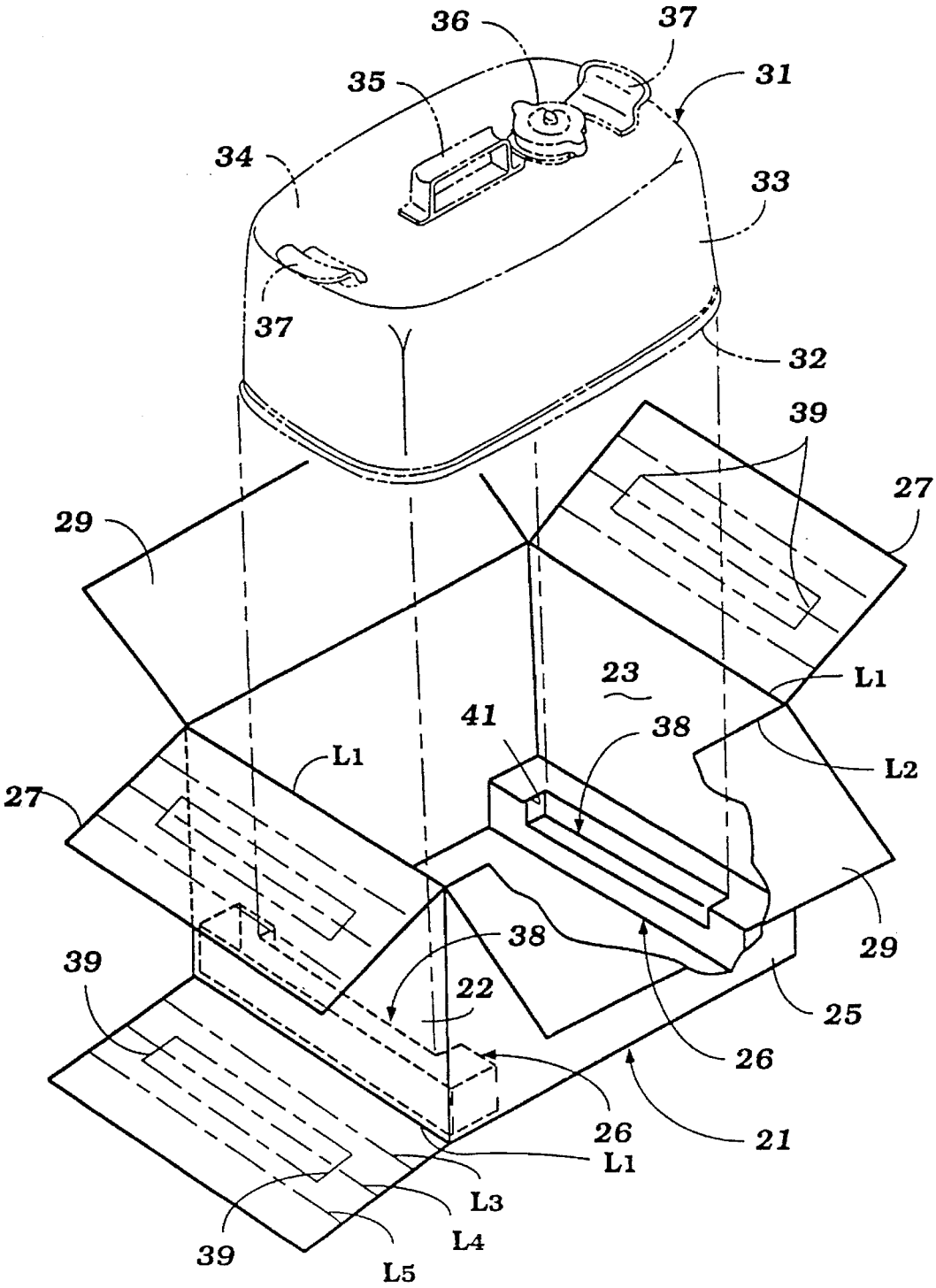
FIG. 1 is an exploded perspective view of a packing box and article to be shipped, the later being shown in phantom, with the box being shown both in a partially folded and partially unfolded condition.

Referring now in detail to the drawings and initially to the embodiment of FIGS. 1 through 6, a shipping box constructed in accordance with this embodiment of the invention is identified generally by the reference numeral 21. In this embodiment, the entire shipping box 21 and the cradle assembly, which will be described later, are formed as a integral component from a corrugated paper. As may be best seen in FIGS. 1 and 5, the box 21 is comprised of end walls 22 and 23, and sides walls 24 and 25 that are joined to each other along folds so that the end walls 21 and 22 and side walls 24 and 25 can be collapsed to form a flat assembly when not in use, for storage and/or for disposal.

A pair of lower end flaps, indicated generally by the reference numeral 26 are formed integrally with the lower ends of the end walls 22 and 23 and are joined thereto by a first scored area L1. In a similar manner, a pair of upper end flaps 27 are connected integrally to the upper ends of the end walls 22 and 23 by a scored area L1. The upper and lower ends flaps 26 and 27 are adapted to be folded, in a manner to be described, to provide at the lower end of the container 21 a cradle and at the upper end a bracing portion for holding an article, to be described, within the box 21 when it is in its packed condition.

A pair of lower side flaps 28 are integrally connected to the lower portion of the side walls 24 and 25 by a scored area L2. In a similar manner, a pair of upper side flaps 29 are connected to the upper ends of the side walls 24 and 25 by a further scored area L2.

The box 21 is adapted to be used for shipping articles and as an example of an article to be shipped, there is shown in phantom lines a gas tank 31 which may be used for an outboard motor. As noted, the gas tank 31 is described as only a typical one of many types of articles that may be shipped in the container or box 21. Other articles such as outboard motors or the like may also be shipped, as will be readily apparent to those skilled in the art.

The gas tank 31 is comprised of a lower wall or base 32 from which upstanding side walls 33 extend so as to merge into a cover 34. A carrying handle 35 is provided centrally of the cover and a fill cap 36 which covers a fill neck (not shown) is positioned at one side of the handle 33. Mounting brackets 37 are also provided at the ends of the top wall 34 for holding the fuel tank 31 in position in use in a watercraft.

It is desirable that the shipping box 21 be slightly larger in all dimensions than the shipped article 31 so as to provide a clearance between the inner periphery of the box 21 and the outer periphery of the shipped article 31. However, it is also necessary to insure that the article 31 is firmly held in position in the box 21 so as to be spaced inwardly from the side walls and to avoid damage in the event the outer periphery of the box 21 becomes crushed or damaged. As has been previously noted, various devices have been proposed for providing this result and this has necessitated the use of either foamed plastic inserts or separate folded inserts. In this embodiment of the invention, the lower end flaps 26 are configured so as to form a supporting cradle and the upper end flaps 27 are formed so as to provide a support for the article 31. The manner in which this is accomplished will now be described.

It is should be noted that both the lower and upper end flaps 26 and 27 are provided with three transversely extending scores L3, L4 and L5. This permits the end flaps 26 and 27 to be folded into a box-like configuration as best shown in FIGS. 2 through 4, although this construction also appears at the lower right hand side of FIG. 1 in solid lines and in broken lines at the lower left hand side.

In addition to this construction, the ends flaps are provided with an arrangement whereby recesses, indicated generally by the reference numeral 38 may be formed so as to not only support the shipped article 31, but so as to retain it against movement in any direction. To accomplish this there are provided a pair of lateral slits 39 formed in each of the end flaps 26 and 27 centrally thereof. These slits 39 extend on opposite sides of the scored area L4 so as to permit the encompassed area to be folded inwardly to form the recesses 38 which are defined then by end areas 41 which engage the opposite sides of the lower wall 32 of the fuel tank 31 so as to support it above the lower wall formed by the side flaps 28 and inwardly of the end walls 22 and 23 and side walls 24 and 25.

Figure 2:
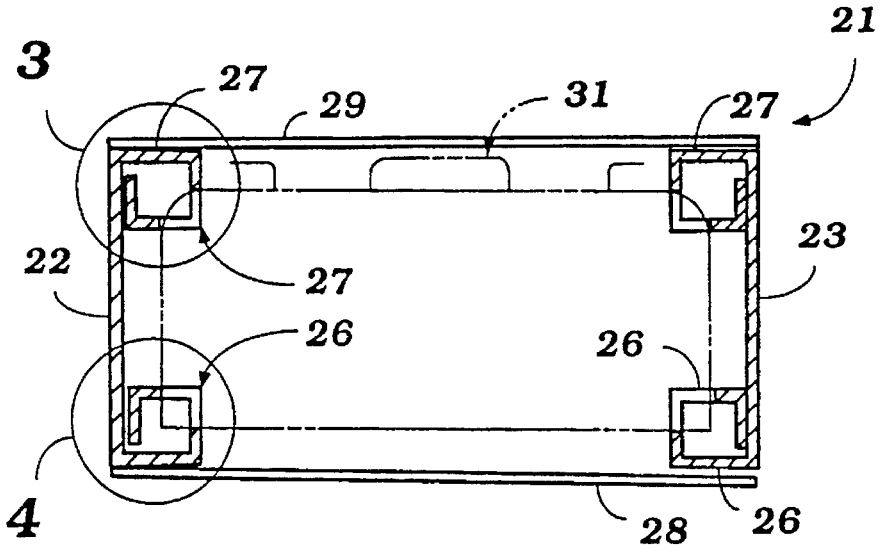
FIG. 2 is a reduced scale cross sectional view taken on a vertical plane of the packing box in its folded condition and showing the shipped article in phantom.
Figure 3:
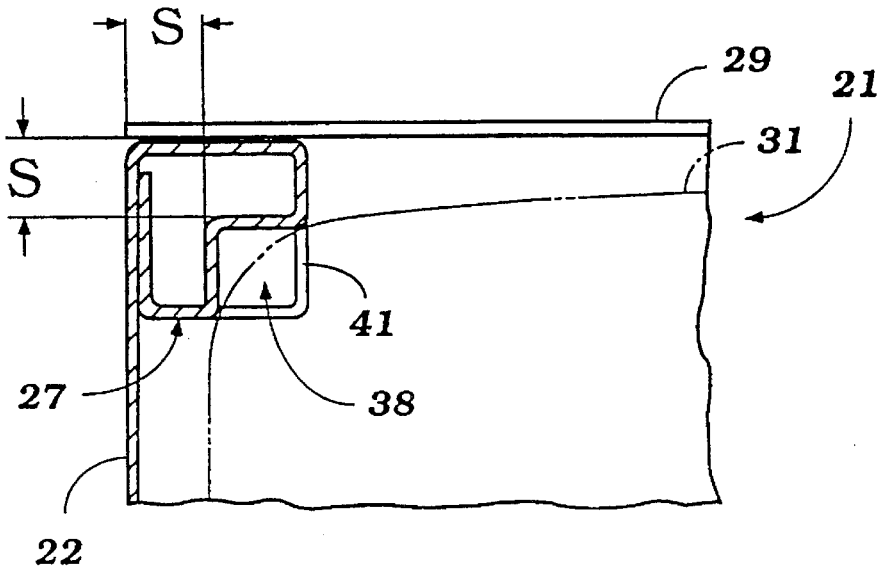
FIG. 3 is an enlarged view of the area encompassed by the circle 3 in FIG. 2.
Figure 4:
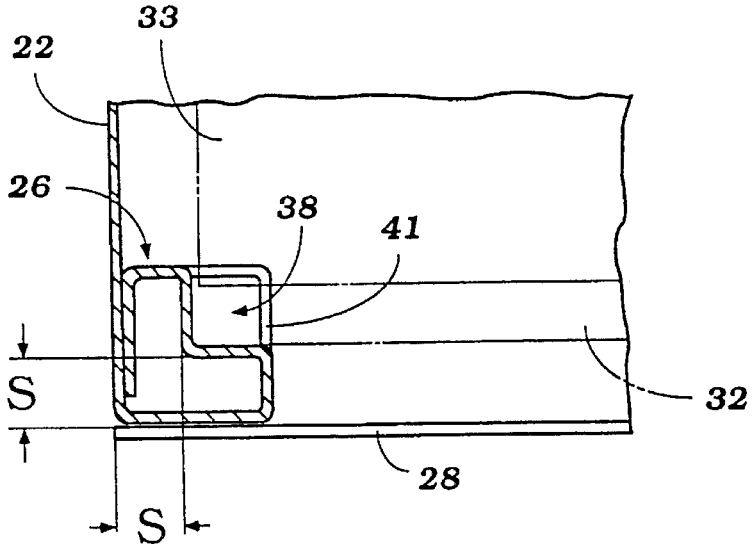
FIG. 4 is an enlarged view of the area encompassed by the circle 4 in FIG. 2.
Figure 5:
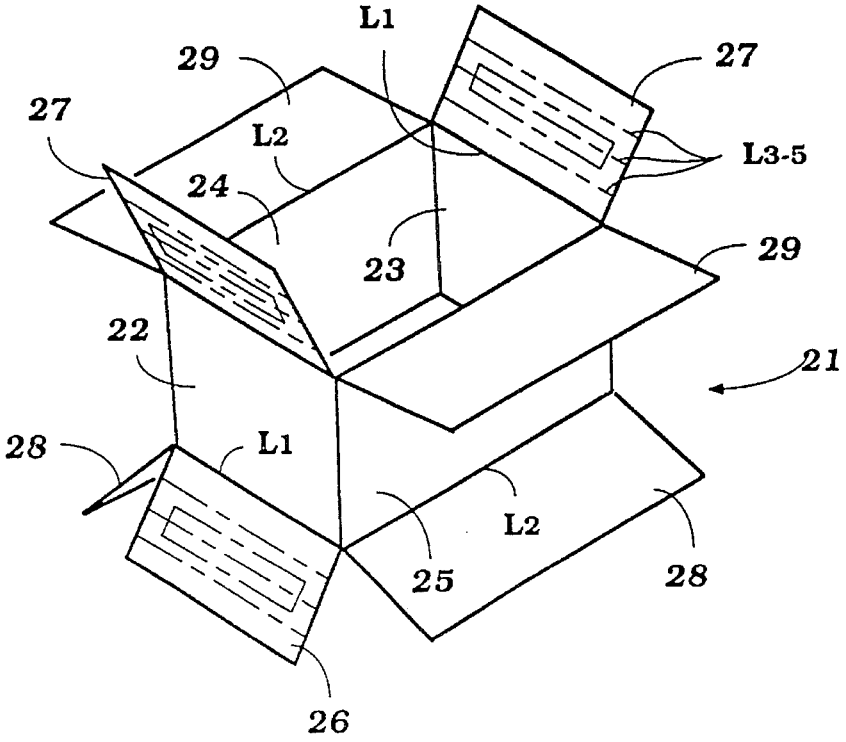
FIG. 5 is a perspective view, in part similar to FIG. 1, but on a smaller scale and shows the box in a partially formed condition with the end flaps all open.

A similar construction is formed at the upper end by the upper flaps 27 which are likewise slitted at 39 and can be folded to form an upper support as best shown in FIGS. 2 and 3. In this way, the gas tank 31 will be rigidly held within the finished folded box 21 and spaced distances S from the side and end walls and top and bottom walls of the completed box so as to insure complete protection if the outer covering of the box 21 becomes damaged. It should also be noted that the construction is such that the box 21 can be conveniently stored flat until it is needed for use and once it has been used it can be again folded back into a flat configuration either for storage for a further use or disposal.

Figure 6:
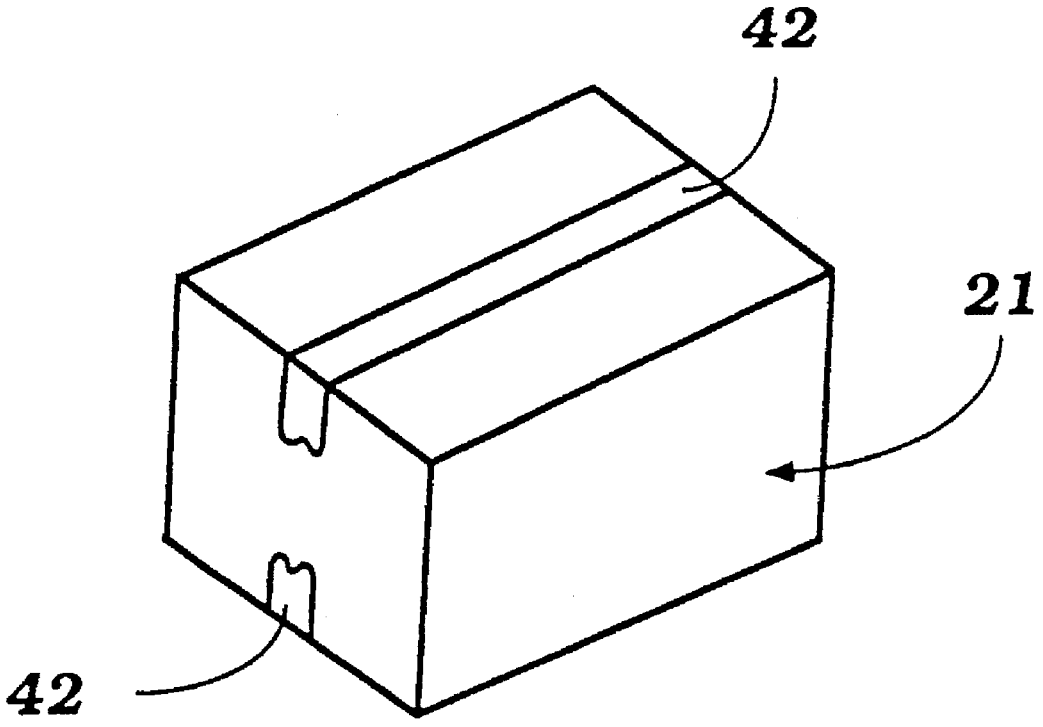
FIG. 6 is a reduced scale perspective view showing the completed box ready for shipping.

As may be seen in FIG. 6, when the box 21 is finally formed and the fuel tank 31 is placed into it, the tops and bottoms may be sealed by suitable packing tape 42 which will join the ends of the top side flaps 29 and bottom side flaps 28.

In the embodiment of the invention as shown in FIGS. 1 through 6, the lower cradle and upper support were formed integrally with the end walls of the container. In some instances, it may be desirable to provide additional lower cradle support and also to provide separate cradle and tops supports. FIGS. 7 through 11 show such an embodiment.

The box in this embodiment is identified also by the reference numeral 21, and except for the elimination of the scored areas L3, L4 and L5 and slits 39 of the top and bottom end flaps, the box 21 may be considered to be the same as that previously described and, for this reason, further discussion of the box 21 per se is not believed to be necessary. Also, the packed article in the illustrated embodiment is also a fuel tank 31 having a construction of the type previously described and, for that reason, the same reference numerals are employed so as to identify the same components of the fuel tank and further description of its construction is not believed to be necessary to understand the construction and operation of this embodiment.

In this embodiment, a cradle assembly, indicated generally by the reference numeral 51 is adapted to be positioned in the lower portion of the box 21 for supporting the fuel tank 31 and spacing it inwardly from the side walls and above the lower wall and also for preventing transverse movement. The cradle assembly 51 is formed from corrugated paper and is made up of four separate pieces comprised of side pieces, indicated generally by the reference numeral 52 and transverse pieces 53. The side pieces 52 and transverse pieces 53 are formed with respective slots 54 so as to lock these pieces together while permitting folding movement thereof, as will be described. The transverse pieces 53 are formed with cut-out portions 55 so as to form a conforming cradle shape for receiving the fuel tank 31 as clearly shown in the figures. In addition, the side pieces 52 have scored end portions 56 that permit them to be folded so as to form end abutments 57 that will engage opposite ends of the fuel tank 31 and hold it against end to end movement within the box 21.

Figures 9, 10, 11:
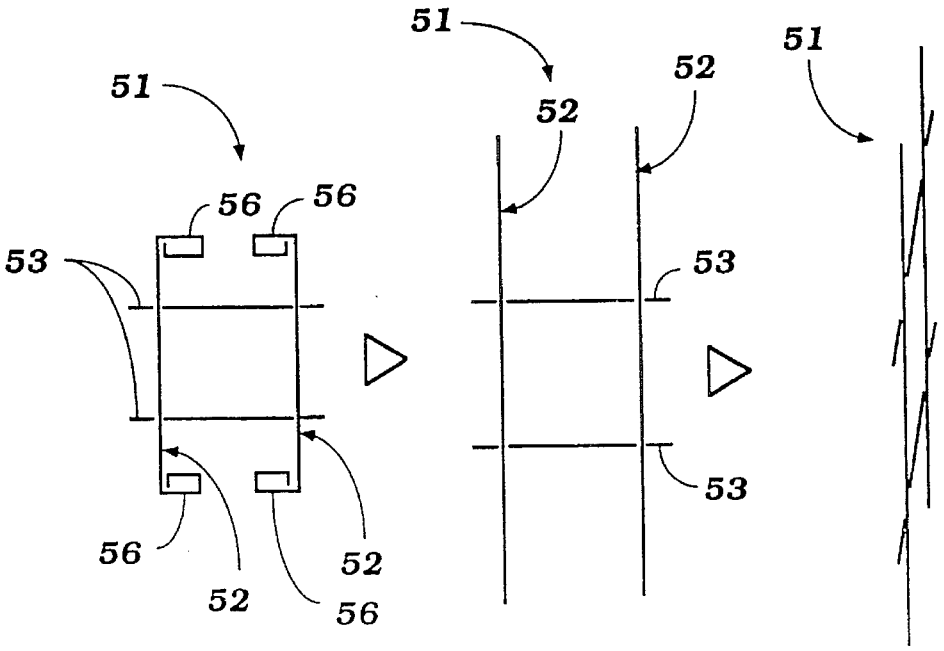
FIGS. 9, 10 and 11 are top plan views showing the shipping cradle in its completely formed, partially formed and knocked down conditions, respectively for the embodiment.

FIGS. 9 through 11 show how the cradle assembly 51 can be stored in a flat condition for either storage or disposal. FIG. 9 is a top view showing how the cradle 51 is folded and formed in its cradle configuration. The device can be knocked down by folding the scored end portions 56 outwardly as shown in FIG. 10. Once this has been accomplished, the box may be folded by hinging the transverse pieces 53 relative to the side pieces 52 along their slit interconnections 54. Obviously, the cradle can be reformed by reversing the steps from FIGS. 11 to 10 to FIG. 9.

Figure 7:
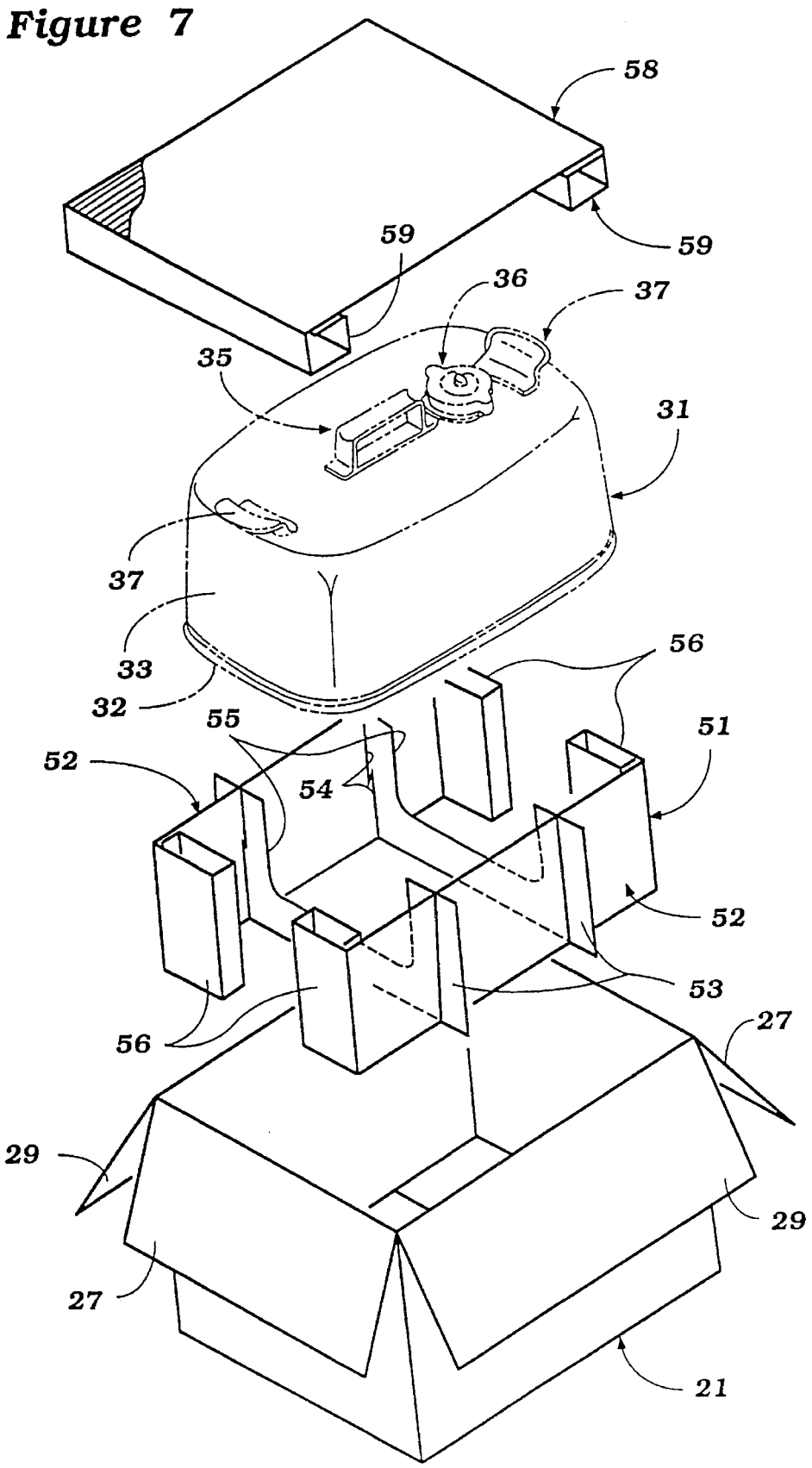
FIG. 7 is an exploded perspective view, in part similar to FIG. 1, and shows another embodiment of the invention.
Figure 8:
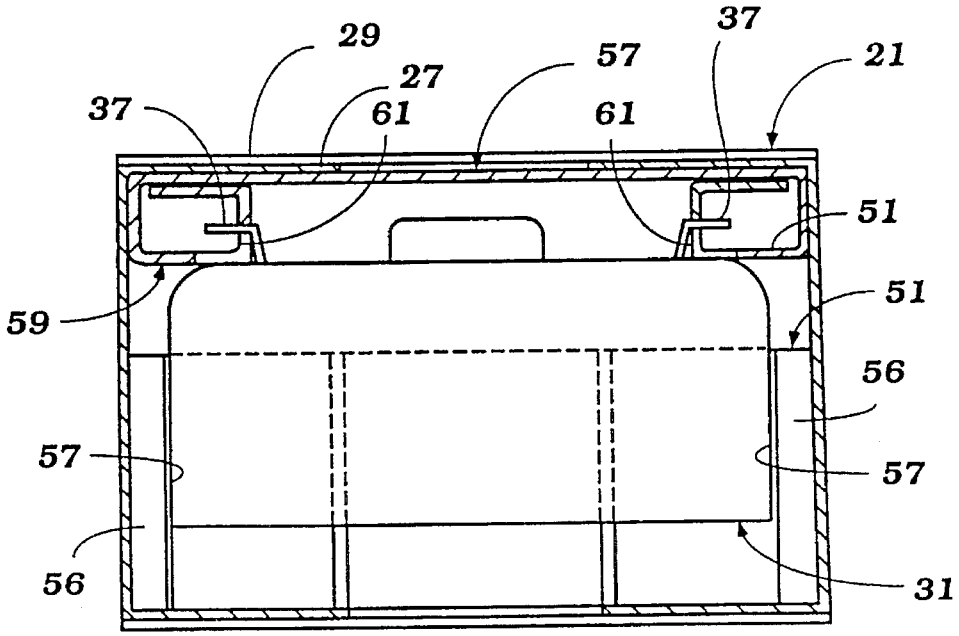
FIG. 8 is a cross sectional view, in part similar to FIG. 2, for this embodiment.

A top support, indicated generally by the reference numeral 58 is also provided and this is formed from corrugated paper having a generally rectangular configuration with end portions that are scored So as to be folded into a box-like configuration 59 as shown in FIGS. 7 and 8. The scored portions 59 may be slit as in the embodiment of FIGS. 1 through 6 so as to form recesses 61 so as to receive the fuel tank hold down portions 37 so as to hold the fuel tank 31 further against transverse movement.

It should be readily apparent from the foregoing description that the described embodiments of the invention permit the entire shipping box to be formed from corrugated material and, at the same time, provide a cradle and support assembly that will hold the shipped article away from the side, end, top and bottom walls of the box and yet not require foamed plastics or any significant complicated folding arrangement. Of course, the foregoing description is that of preferred embodiments of the invention and various changes and modifications can be made without departing from the spirit and scope of the invention, as defined by the appended claims.

We claim:

1. A packing box for shipping an article, said packing box being formed from corrugated paper and comprising a first part formed into a substantially cubical box configuration comprised of four sides scored and folded at their junctures and upper and lower end flaps scored and folded from the sides for forming top and bottom closures and for receiving and containing a shipped article, the interior of said packing box defining a volume receiving a second part forming at least a lower cradle shaped portion defining a recess to receive and nest the shipped article within said box and space the shipped article inwardly from the inner surface of said box for shipping protection, said cradle shaped portion being formed solely from corrugated paper and comprised of a plurality of first sections spaced from each other and of a width equal to the width of the interior of said packing box the first sections having slots receiving a plurality of second sections extending perpendicular to said first sections to space said first sections from each other and space said second sections from each other, said cradle shaped portion being foldable from said cradle shaped portion to a generally flat configuration, said second sections each having a length at least equal to the length of the interior of said packing box.

2. A packing box for shipping an article as set forth in claim 1 wherein the cradle shape portion first sections form spaced apart horizontal support surfaces for holding a shipped article above the lower wall of the box.

3. A packing box for shipping an article as set forth in claim 1 wherein the cradle shape portion second sections form spaced apart end engaging surfaces adapted to engage ends of a shipped article and hold the shipped article spaced inwardly from the ends of the box, said end engaging surfaces being formed by folded and scored portions of said the ends of said second sections.

4. A packing box for shipping an article as set forth in claim 1 wherein the cradle shape portion first sections further define spaced apart side surfaces for engaging sides of a shipped article for holding it in spaced relationship to the sides of the formed box.

5. A packing box for shipping an article as set forth in claim 4 wherein the cradle shape portion first sections further form spaced apart horizontal support surfaces for holding a shipped article above the lower wall of the box.

6. A packing box for shipping an article as set forth in claim 5 wherein the cradle shape portion second sections form spaced apart end engaging surfaces adapted to engage ends of a shipped article and hold the shipped article spaced inwardly from the ends of the box, said end engaging surfaces being formed by folded and scored portions of said the ends of said second sections.

7. A packing box for shipping an article as set forth in claim 4 wherein the first sections of the second part are with cut-outs complementary to a shipped article and receiving the shipped article.

* * * * *